United States Patent [19]

Stettner et al.

[11] Patent Number: 4,720,112

[45] Date of Patent: Jan. 19, 1988

[54] ADJUSTABLE STANDARD FOR NET GAMES

[76] Inventors: Keith A. Stettner; Stephen Hamilton, both of 125 E. Washington Blvd., Lombard, Ill. 60148

[21] Appl. No.: 905,401

[22] Filed: Sep. 10, 1986

[51] Int. Cl.[4] ..... A63B 61/02

[52] U.S. Cl. ..... 273/411; 273/29 BB

[58] Field of Search ..... 273/411, 29 B, 29 BA, 273/29 BB, 29 BC, 29 BD, 29 BE, 29 BF, 29 BG

[56] References Cited

U.S. PATENT DOCUMENTS 4,135,716 1/1979 Ginsburg ..... 273/29 BC 4,415,163 11/1983 Schoenig ..... 273/411

*Primary Examiner*—William H. Grieb

*Attorney, Agent, or Firm*—A. G. Douvas

[57] ABSTRACT

A net supporting standard for net games comprising a pair of elongated, thinwall, cylindrical plastic tubes diametrically sized so that one tube telescopes adjustably within the bore of the second or base tube. Each tube has a set of spaced holes formed in the associated tube wall. A hitch pin inserted through various combinations of overlying and mated holes locks the two tubes to establish a selectable length for the standard suitable for supporting a game net at three different heights appropriate for men's volleyball, women's volleyball, or badminton, as desired.

8 Claims, 9 Drawing Figures

16
12
17
22
24
20
E
18
5
4
15
9
D
23
19
B
10
38
21
C
8
A
11

ADJUSTABLE STANDARD FOR NET GAMES

BACKGROUND OF THE INVENTION

This invention relates to an adjustable standard for supporting a variety of game nets at the appropriate heights for men's or women's volleyball, or badminton.

There is extensive prior art relating to net supporting standards for games. Most of these standards are suitable for only a single game. The more versatile standards, which may be used for several different games, generally represent a compromised design which has several undesirable features. Certain of the detrimental features include cumbersome and weighty structure which makes transportation, assembly and disassembly difficult, time consuming and difficult height adjustments which may require disassembly of the standard to change height, and inability to hold a net tightly due to structural weakness.

SUMMARY OF THE INVENTION

Accordingly, a principal object of the invention is to provide a versatile net-supporting standard suitable for use in several different games and which is easily and quickly adjustable for different desired heights, compact and readily transportable, and which will reliably support a game net. A preferred embodiment of the net-supporting game standard of this invention comprises two rigid plastic tubes which are sized so that one tube telescopes adjustably within the other tube. A plurality of holes pass through the cylindrical walls of both tubes. The holes of both tubes are spaced so that they may be locked together, in selected pairs, one from each tube, by a height adjusting hitch pin which passes through the mated holes of both tubes.

The various combinations of hitch-pin locked holes are selectively capable of supporting a net at an appropriate height for men's or women's volleyball, or badminton.

The standard is vertically positioned by the combined forces developed by the supported net and a pair of ground anchored guys. The standard is placed directly on the ground without recourse to a baseplate, weighted base, or ground spike.

The upper tube of the standard is formed with a pair of alignment grooves and three sets of spaced punch marks. These elements enable the two tubes of a standard to be aligned and telescoped so that the height adjusting hitch pin can be easily and quickly inserted into the proper set of mating holes without repeated trial and error steps.

BRIEF DESCRIPTION OF THE DRAWINGS

In order that all of the stuctural features for attaining the object of this invention may be readily understood, detailed reference is made to the drawings wherein.

DETAILED DESCRIPTION OF THE PREFERRED EMBODIMENT

Figure 1:
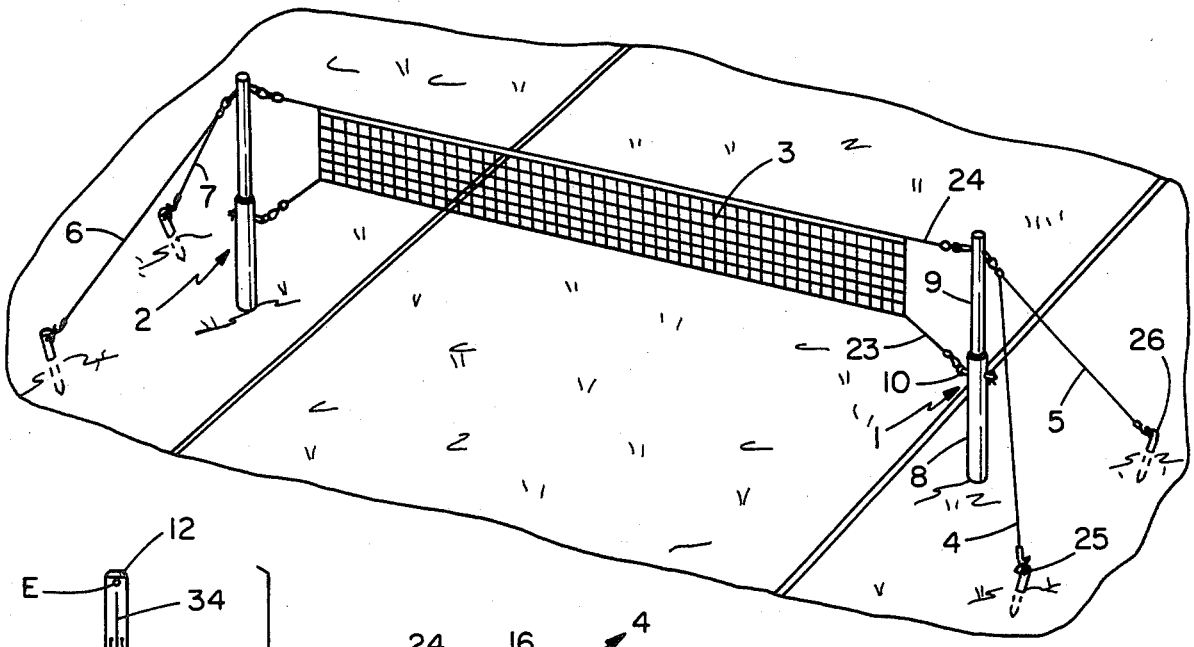
FIG. 1 is a perspective view of two standards of this invention supporting a volleyball net.
Figure 3:
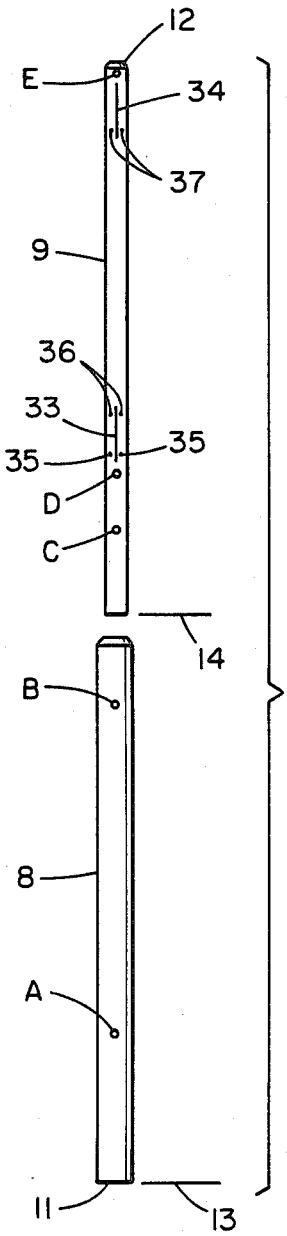
FIG. 3 is an elevation view showing the height adjusting holes, the alignment grooves, and the alignment punch marks for each of the two telescoping tubes of each standard.

Referring to FIG. 1, net support standards 1 and 2 of the invention are shown adjusted to support volleyball net 3. Net 3 and guys 4 and 5 are tensioned to hold standard 1 in a vertical disposition, and net 3 and guys 6 and 7 hold standard 2 in a vertical disposition. In a typical installation on a grass or dirt playing field, standards 1 and 2 are placed directly on the ground without a baseplate. Standards 1 and 2 are identical in construction, and therefore the following detailed description is generally limited to standard 1, various aspects of which are shown in FIGS. 2 through 9.

Standard 1 comprises two telescoping cylindrical plastic tubes 8 and 9 (FIG. 3) which are sized so that tube 9 fits slideably tight within the bore of tube 8. Tube 8 is formed with two spaced through-holes A and B, and tube 9 is formed with three spaced through-holes C, D and E. Height adjusting hitch pin 10 is passed through selected sets of aligned holes in both tubes (FIGS. 5-8), so that the overall length of standard 1 may be selectively adjusted to position a net for badminton (FIG. 6), women's volleyball (FIG. 7), or men's volleyball (FIG. 8).

Figure 2:
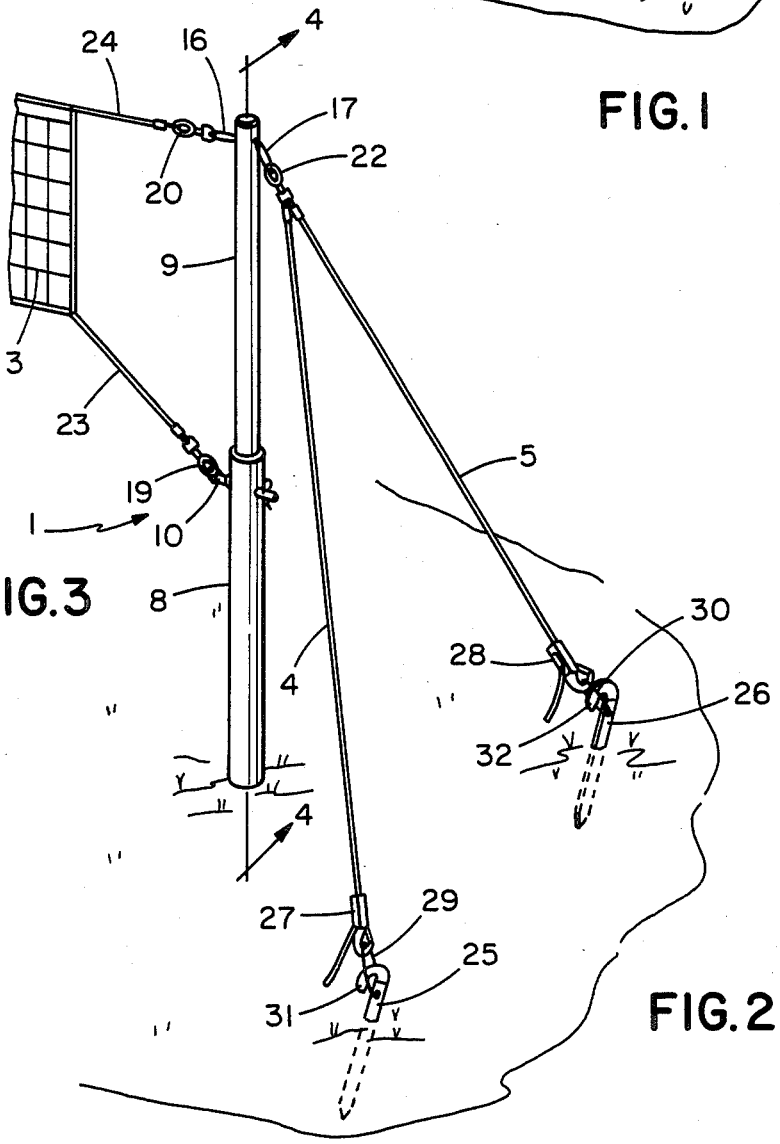
FIG. 2 is an enlarged perspective view of the right standard of FIG. 1 showing guying details.

In a preferred embodiment, tubes 8 and 9 are fabricated from polyvinyl chloride pipe (PVC Schedule 80 manufactured by R & G Sloane Manufacturing Company, Inc.). Tube 8 is a nominal 2" size having an outside diameter of 2.375" with a 0.218" wall thickness, and tube 9 is a nominal 1.5" size having a 1.900" outside diameter with a 0.200" wall thickness. Tubes 8 and 9 of these nominal sizes telescope together tightly to form a rigid standard 1 which neither bows nor bends when guyed to support a net as shown in FIGS. 1 and 2. Additionally, the standard may be placed directly on the ground without a base support plate, because the downwardly directed force exerted on standard 1 by net 3 and guys 4 and 5 is effectively carried by the lower end of tube 8 whose bearing surface is increased by fixing (gluing) circular polyvinyl chloride plug 11 within the lower bore of tube 8 so that a fairly large blunt surface bears against the supporting ground. The mating upper end of tube 8 and the lower end of tube 9 are both open, and the upper ends of both tubes 8 and 9 are both beveled to facilitate manual handling. The upper end of tube 8 is closed by a circular polyvinyl chloride plug 12 which is glued to the inner wall of tube 9.

In a preferred embodiment, tube 8 is 57" long and holes A and B are centered 15.32" and 50.32", respectively, above ground base line 13 (FIG. 3); and tube 9 is 58" long and holes C, D and E are centered 8", 15", and 57", respectively, from reference line 14.

Figures 4, 5, 6, 7, 8, 9:
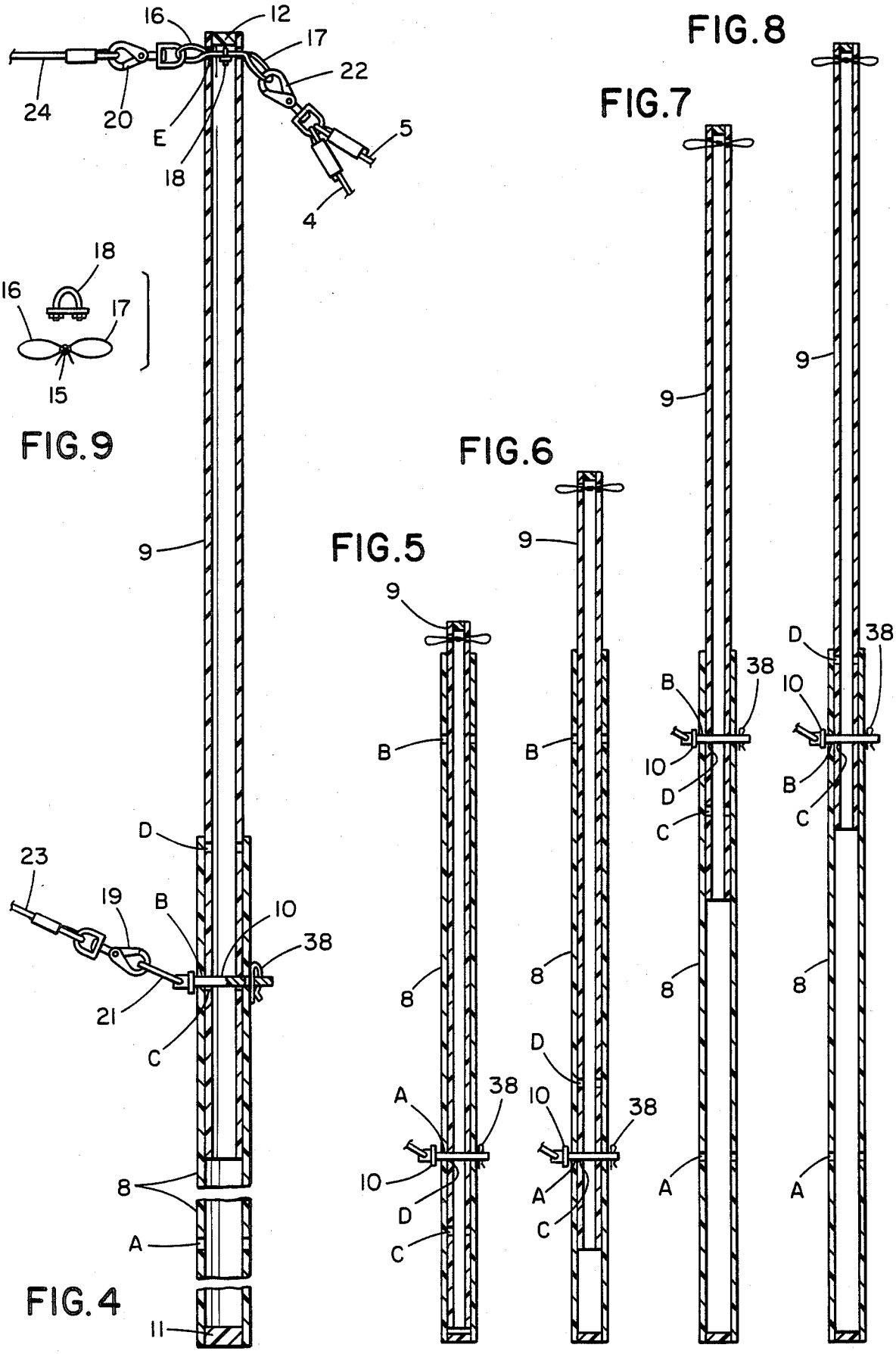
FIG. 4 is a section view taken along line 4—4 of FIG. 2 showing details of the height adjusting hitch pin, and rope loops for receiving the net and guy snaphooks.
FIGS. 5, 6, 7 and 8 are views related to FIG. 4 showing the four alternative positions of the height adjusting hitch pin for (1) the closed position, (2) badminton, (3) women's volleyball, or (4) men's volleyball.
FIG. 9 is a diagram showing an arrangement for forming the loops for engaging the guy and net snaphooks.

Before plug 12 is fixed to the upper end of tube 9, a short piece of Nylon rope 15 (FIG. 9) is inserted into hole E and is folded into a FIG. 8 shape (or configuration) to form a pair of ringlike loops 16 and 17 projecting from both sides of hole E. U-clamp 18 is fixed to the common intersection of loops 16 and 17 and is positioned within the bore of tube 9. Since clamp 18 is larger than the hole E opening, loops 16 and 17 remain fixed relative tube 9.

When height-adjusting hitch pin 10 passes through holes A and D (FIG. 5), standard 2 is approximately 58.375" long, and is in the closed position.

When hitch pin 10 passes through holes A and C (FIG. 6), standard 1 is approximately 64.25" long, and a net (not shown) may be supported at an approximate height of 60.5" to 61.5" which is appropriate for badminton, by connecting net snaphooks 19 and 20 (FIG. 4) to ring 21 of hitch pin 10 and loop 16. Hitch pin 10 is locked in place by wire clip 38.

Snaphook 22 engages loop 17 to couple guys 4 and 5 to tube 9. Accordingly, standard 1 is maintained in a rigid vertical disposition by the forces applied by net cables 23 and 24, and guys 4 and 5. Guys 4 and 5 are anchored to ground stakes 25 and 26 (FIG. 2) by snaphooks 27 and 28 which engage rope loops 29 and 30. Loops 29 and 30 are preferably coupled to stakes 25 and 26 and capturing the loops within curved protective heads 31 and 32, formed on the exposed end of stakes 25 and 26, respectively.

Similarly, when hitch pin 10 passes through holes B and D (FIG. 7), standard 1 is approximately 93.375" long, and a net (not shown) may be supported at an approximate height of 7'4" to 7'6" which is appropriate for women's volleyball.

An appropriate net height for men's volleyball is attained by passing hitch pin 10 through holes B and C (FIG. 8). Standard 1 is then elongated to approximately 99.5" and volleyball net 3 is supported at a height of approximately 7'11" to 8'1".

Tube 9 has two elongated alignment grooves 33 and 34 (FIG. 3) and three sets of painted punch marks 35, 36 and 37 formed on the outer wall of tube 9. These grooves and punch marks facilitate aligning the various holes A, B, and C and D, so that hitch pin 10 can pass through the pair of holes, A and D, A and C, B and D, or B and C, without objectional trial and error in order to mate the correct holes by rotating tubes 8 and 9 relative to one another and adjusting the extent of telescoping. Groove 34 is approximately 9" long, extending entirely below hole E, and groove 33 is approximately 10" long, extending on both sides of hole D. Grooves 33 and 34 and holes C, D and E are in longitudinal alignment.

Each set of punch marks 35, 36 and 37 straddle an associated groove 33 or 34. Punch mark sets 35, 36 and 37 are located 15.875", 21.875" and 50.75", respectively, from the lower end of tube 9. When tubes 8 and 9 are telescoped so that one of punch mark sets 35, 36 or 37 is slightly exposed above the upper end of tube 9, then holes B and C, or B and D, or A and C, are mated respectively.

It should be understood that the above described embodiment is merely illustrative of the principles of this invention, and that modification can be made without departing from the scope of the invention.

What is claimed is:

1. A net supporting standard for net games, comprising a pair of elongated thinwall cylindrical plastic tubes diametrically sized so that one tube telescopes adjustably within the bore of the second or base tube; a first set of holes passing through the wall of the one tube and with the holes being spaced along the longitudinal axis of the tube; a second set of holes passing through the wall of the second tube and with the holes being spaced along the longitudinal axis of the second tube; both sets of holes being selectively located on their tubes so that the alignment of various combinations of paired holes one from each tube telescopes the two tubes to a proper length for supporting a game net at an appropriate height; means engaging the selected combination of paired holes to lock the telescoped tubes to a fixed length; means for attaching a net to the standard, means for attaching a guy to the one tube; and in which the two sets of holes are selectively located through the walls of two tubes so that different combinations of paired holes will adjustably telescope the standard from a closed position to a men's volleyball, or women's volleyball, or badminton, net height; and in which the second tube has selectively spaced holes A and B, and the one tube has selectively spaced holes C and D, and in which locked paired holes A and D, A and C, B and D, and B and C, establish a closed position or net heights for badminton, women's volleyball, and men's volleyball, respectively; and in which the one tube has a third hole located near the tube end removed from the second tube and through which hole a double attaching loop passes to which a supported net attaches to one loop and a guy attaches to the other loop; and in which the means engaging the selected pair of holes is a pin; and elongated line means located on the outer surface of the one tube for aligning the holes of both tubes for pin insertion through a set of paired holes.

2. The combination of claim 1 in which the elongated line means are grooves.

3. The combination of claim 2 comprising second means associated with the elongated line means on the outer surface of the one tube which are visual indicators of the degree of tube telescoping required to establish a selected net height.

4. The combination of claim 3 in which the second means comprises several sets of punch marks straddling the elongated line means.

5. A net supporting standard for net games, comprising a pair of elongated thinwall cylindrical plastic tubes diametrically sized so that one tube telescopes adjustably within the bore of the second or base tube, a first set of holes passing through the wall of the one tube and with the holes being spaced along the longitudinal axis of the tube, a second set of holes passing through the wall of the second tube and with the holes being spaced along the longitudinal axis of the second tube, both sets of holes being selectively located on their tubes so that the alignment of various combinations of paired holes one from each tube telescopes the two tubes to a proper length for supporting a game net at an appropriate height, a pin engaging the selected combination of paired holes to lock the telescoped tubes to a fixed length, means for attaching a net to the standard, means for attaching a guy to the one tube, and elongated line means located on the outer surface of the one tube for aligning the holes of both tubes for pin insertion through a set of paired holes.

6. The combination of claim 5 in which the elongated line means are grooves.

7. The combination of claim 6 comprising a second means associated with the elongated line means on the outer surface of the one tube which are visual indicators of the degree of tube telescoping required to establish a selected net height.

8. The combination of claim 7 in which the second means comprises several sets of punch marks straddling the elongated line means.

* * * * *